US008790474B2

(12) United States Patent
Peutl et al.

(10) Patent No.: US 8,790,474 B2
(45) Date of Patent: Jul. 29, 2014

(54) REDUCTION GRIPPER FOR A COLD GLUE UNIT

(71) Applicant: Krones AG, Neutraubling (DE)

(72) Inventors: August Peutl, Wörth (DE); Paul Helmberger, Kallmünz (DE); Bernhard Domeier, Hohengebraching (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 13/681,595

(22) Filed: Nov. 20, 2012

(65) Prior Publication Data

US 2013/0146203 A1 Jun. 13, 2013

(30) Foreign Application Priority Data

Dec. 9, 2011 (DE) ..... 10 2011 088 096

(51) Int. Cl.

| | |
|---|---|
| ***B32B 41/00*** | (2006.01) |
| ***B65C 3/20*** | (2006.01) |
| ***B65C 3/24*** | (2006.01) |
| ***B65C 9/16*** | (2006.01) |

(52) U.S. Cl.

CPC ... *B65C 3/20* (2013.01); *B65C 3/24* (2013.01); *B65C 9/16* (2013.01)

USPC ..... 156/64; 156/202; 156/350; 156/351; 156/368; 156/378; 156/379; 156/476; 156/480; 156/560; 156/568; 156/571; 156/DIG. 14; 156/DIG. 32; 156/DIG. 42

(58) Field of Classification Search

CPC ..... B65C 3/20; B65C 3/24; B65C 9/16

USPC ..... 156/64, 202, 350, 351, 368, 378, 379, 156/476, 480, 560, 568, 571, DIG. 14, 156/DIG. 32, DIG. 42

See application file for complete search history.

(56) References Cited

U.S. PATENT DOCUMENTS

| | | | | |
|---|---|---|---|---|
| 4,146,421 | A | 3/1979 | Zodrow | |
| 4,280,866 | A | 7/1981 | Zodrow et al. | |
| 4,323,029 | A * | 4/1982 | Knuppertz et al. | 118/231 |
| 2002/0046801 | A1 | 4/2002 | Spatafora et al. | |

FOREIGN PATENT DOCUMENTS

| | | |
|---|---|---|
| DE | 1290865 A | 3/1969 |
| DE | 7436259 U | 2/1975 |
| DE | 2544277 B2 | 4/1977 |
| DE | 2845645 B1 | 4/1980 |

(Continued)

OTHER PUBLICATIONS

German Search Report for 102011088096.8, dated Apr. 24, 2012.

(Continued)

*Primary Examiner* — Katarzyna Wyrozebski Lee
*Assistant Examiner* — Joshel Rivera
(74) *Attorney, Agent, or Firm* — Marshall, Gerstein & Borun LLP

(57) ABSTRACT

A device for transferring labels in a labeling machine with at least two retaining elements for holding labels, with the retaining elements being mounted offset in the circumferential direction around a gripper cylinder axle, and a mechanical control means configured to change the relative speed between the retaining elements in the circumferential direction of the gripper cylinder.

13 Claims, 8 Drawing Sheets

(56) References Cited

FOREIGN PATENT DOCUMENTS

| | | | |
|---|---|---|---|
| DE | 2905376 | A1 | 8/1980 |
| DE | 19845964 | A1 | 6/2000 |
| DE | 20003798 | U1 | 6/2000 |
| DE | 60102762 | T2 | 3/2005 |
| EP | 0141338 | A1 | 5/1985 |
| EP | 1640274 | A2 | 3/2006 |

OTHER PUBLICATIONS

European search report for EP12 19 1103, dated Mar. 13, 2013.

* cited by examiner

REDUCTION GRIPPER FOR A COLD GLUE UNIT

CROSS-REFERENCE TO RELATED APPLICATION

The present application claims the benefit of priority of German Application No. 102011088096.8, filed Dec. 9, 2011. The entire text of the priority application is incorporated herein by reference in its entirety.

FIELD OF THE DISCLOSURE

The disclosure relates to a device for transferring labels in a labeling machine and to a corresponding method.

BACKGROUND

In the labeling of containers, in particular in cold glue labeling, there are many variants for the combination of label feeders, i.e. pallet units, bottle carousels with the containers to be labeled, and the transfer units used in-between, i.e. gripper cylinders. In particular, the pitch of the bottle carousel, i.e. how many bottles or containers per angular element are to be labeled on the carousel, the pitch of the feeder, i.e. how many transfer positions and thus pallets per angular element are provided, have an influence on the pitch of the transfer unit, i.e. the gripper cylinder, to be selected. Here, the label length of the labels to be transferred also plays a decisive role. In prior art, when the label length is changed, the gripper cylinders also must be changed, and often the complete gripper cylinder unit must be exchanged. One problem here is that the synchronization of the three units, that means the pallet rotor/feeder, the gripper cylinder unit and the bottle carousel, must be ensured, so that the containers can be labeled with the desired labels at a provided speed.

DE 29 05 376 shows a transport starwheel for bottles with a rotatingly driven support at which several conveyor holders are provided, wherein the conveyor holders can be swiveled relative to the support by means of a stationary control cam, so that one can allow for a predetermined pitch in the running-in area and another predetermined pitch in the discharge area. Independent of the control cam, the smallest pitch is determined only by the stops of the conveyor holders by elastic means, and several bottle diameters can be driven with one single cam shape.

SUMMARY OF THE DISCLOSURE

In view of prior art and the above-discussed problems, it is one aspect of the present disclosure to decouple the dependency of the gripper cylinder pitch from the pallet control and pitch and to thus reduce the variants.

The disclosure includes a device for transferring labels in a labeling machine with at least two retaining elements for retaining labels, the retaining elements being mounted offset in the circumferential direction around a gripper cylinder axle of a gripper cylinder, wherein the device comprises mechanical control means which are configured to vary the relative speed between the retaining elements in the circumferential direction of the gripper cylinder.

The transfer of labels from pallets onto the gripper cylinder can be carried out thereby in a constant manner. The gripper settings of the retaining elements at the gripper cylinder only have to be matched, that means adjusted, once, for example with respect to a pallet setting. After the adjustment, these gripper cylinder settings can remain practically unchanged.

The retaining elements of the gripper cylinder perform a reduction motion relative to each other. By this, for example, the retaining elements of the gripper will change their relative speed with respect to each other in the circumferential direction. The change of speed is accompanied by accelerations or delays occurring relatively to each other. These can be performed to take up the movement of the pallets. Here, the retaining elements are typically mounted at the outer periphery of the gripper cylinder and have essentially the same distance from the axle of the gripper cylinder. In other words, the relative motion of the retaining elements in the circumferential direction of the gripper cylinder changes with respect to the rotation of the gripper cylinder around the gripper cylinder axle which remains essentially unchanged. This results, in the form of a roll-off movement, in the advantage that the labels can be constantly pulled off from the pallet, even with different label lengths. This furthermore results in the advantage that in particular even very short labels can be still processed, which could hardly be done with a conventional gripper cylinder. The reduction of a reduction motion to the gripper cylinder furthermore permits to better process labels that are susceptible to tearing. Up to now, this problem was allowed for by an additional special rotation of the pallet at the transfer point, for which a considerable amount of calculation and control efforts was necessary and optionally control cams had to be exchanged.

In the device, the mechanical control means can comprise, for example, a control cam and a circular path.

By the use of specified control cams, the mechanical means can be adapted to the requirements of the device and the labeling machine in many ways and robustly.

In the device, the retaining elements can comprise at least two elements which are connected to each other in a lever type fashion, i.e. like levers, about an axle which is essentially in parallel to the gripper cylinder axle, the upper element being configured to grip labels and be guided on the circular path, and the lower element being guided on the control cam.

By the division into a lower element and an upper element, proportions of motion in the circumferential and radial directions can be decoupled.

In the device, the lower element can comprise a toggle lever which is, for example, angled, and a cam roller support with at least one cam roller which is configured to roll along the control cam.

Suited control cams which are adapted to the labeling machine can be installed. The lower element can follow the control cams with a toggle lever, which is for example angled at a fixed angle. For this, cam roller supports can hold one or several cam rollers which follow the control cams inside and/or outside.

The upper element of the device can comprise at least one lever element which is configured to be movable about an axis which is essentially parallel to the gripper cylinder axle.

The upper element can typically comprise a slide with at least one guide roller, such that the upper element is guided on the circular path.

The slide can thereby follow the circular path with one or several guide rollers. The upper element can comprise at least two parts which are connected with a quick-lock element, so that the slide is exchangeable as a front part and the rear part remains at the retaining element.

This results in the advantage that in case of a change, only one part of the upper element of the retaining element must be changed, while the part of the upper element located radially further inside can remain at the device, thereby saving time and facilitating maintenance works.

In the device, each retaining element can preferably have a separate drive, for example a servomotor, so that the position of the retaining element can be adjusted by means of the servomotor.

By means of a drive, for example a servomotor, the position of the retaining element can be adjusted. In particular after a change of labels, the gripper cylinder can be rotated relative to the pallet control in a suited manner, so that the new label can be gripped again at a desired transfer point. The servomotor permits a simple and precise and controllable adjustment of a thus defined new basic position of the retaining element of the gripper cylinder.

In the device, the upper element of the retaining elements can comprise at least one anvil element, one pressing pad, and along the anvil element, at least one gripper finger which can be adjusted between a grip and a release position with respect to the anvil element. The positions of the gripper finger can be controlled by further mechanical or electric control means. For example, a further mechanical control cam can be used for controlling the gripper fingers.

The mentioned elements are typically mounted in the front part of the upper element/slide of the retaining element which is located radially further outside. Here, the reduction function of the gripper cylinder permits that only an essentially straight anvil rail is required. Equally, only one finger variant is required as only one straight anvil must be employed. Furthermore, the gripper fingers and the anvil rails do no longer have to be adjustable, whereby simplifications in view of the construction can result. This gives rise to possibilities of simplification which can lead to savings of time and costs.

In the device, the circular path guidance of the upper element can comprise a support board, which is configured to rotate practically with constant rotation.

The support board can perform an essentially constant rotation, while the reduction function can be performed by the retaining elements relative to each other.

The retaining elements of the device can be interconnected such that they can be exchanged coherently.

As an alternative, the retaining elements of the device can be designed such that they can be exchanged individually.

If in view of the bottle carousel, a change of the gripper elements must be effected, these can consequently be exchanged or replaced either as a complete unit, or individual retaining elements can be exchanged in a suited manner. Here, the control cams can remain as they are.

The disclosure furthermore includes a method of transferring labels in a labeling machine with a device as described above; with a pallet rotor with several pallets which are provided in a first pitch at the pallet rotor; wherein the pallet rotor is rotatable about an axis which is essentially parallel to the gripper cylinder axle; with a container carousel with several rotary tables with containers which are provided in a second pitch; wherein after the acceptance of a label from the pallet by the retaining elements, the retaining elements are adjusted to the second pitch of the container carousel by changing the relative speed between the retaining elements in the circumferential direction of the gripper cylinder.

By changing the relative speed between the retaining elements in the circumferential direction of the gripper cylinder, the distance between the retaining elements on the periphery of the first pitch corresponding to the pallet rotor is thus adapted to the second pitch corresponding to the container carousel by the method.

In the method, the basic position of the retaining element can be adjustable relative to a pallet, so that labels of different lengths are gripped essentially at the same point.

So, the transfer point in the transfer of labels from pallets of the pallet rotor to the retaining elements of the gripper cylinder can remain essentially unchanged. Only the switch point in the label discharge to the containers must be optionally adjusted again, in case of a changed label length, if the label is to be transferred centrically onto a container.

BRIEF DESCRIPTION OF THE DRAWINGS

The subject matter of the disclosure will be illustrated by way of example with reference to the following drawings.

In the drawings.

DETAILED DESCRIPTION OF THE PREFERRED EMBODIMENTS

Figure 1A:
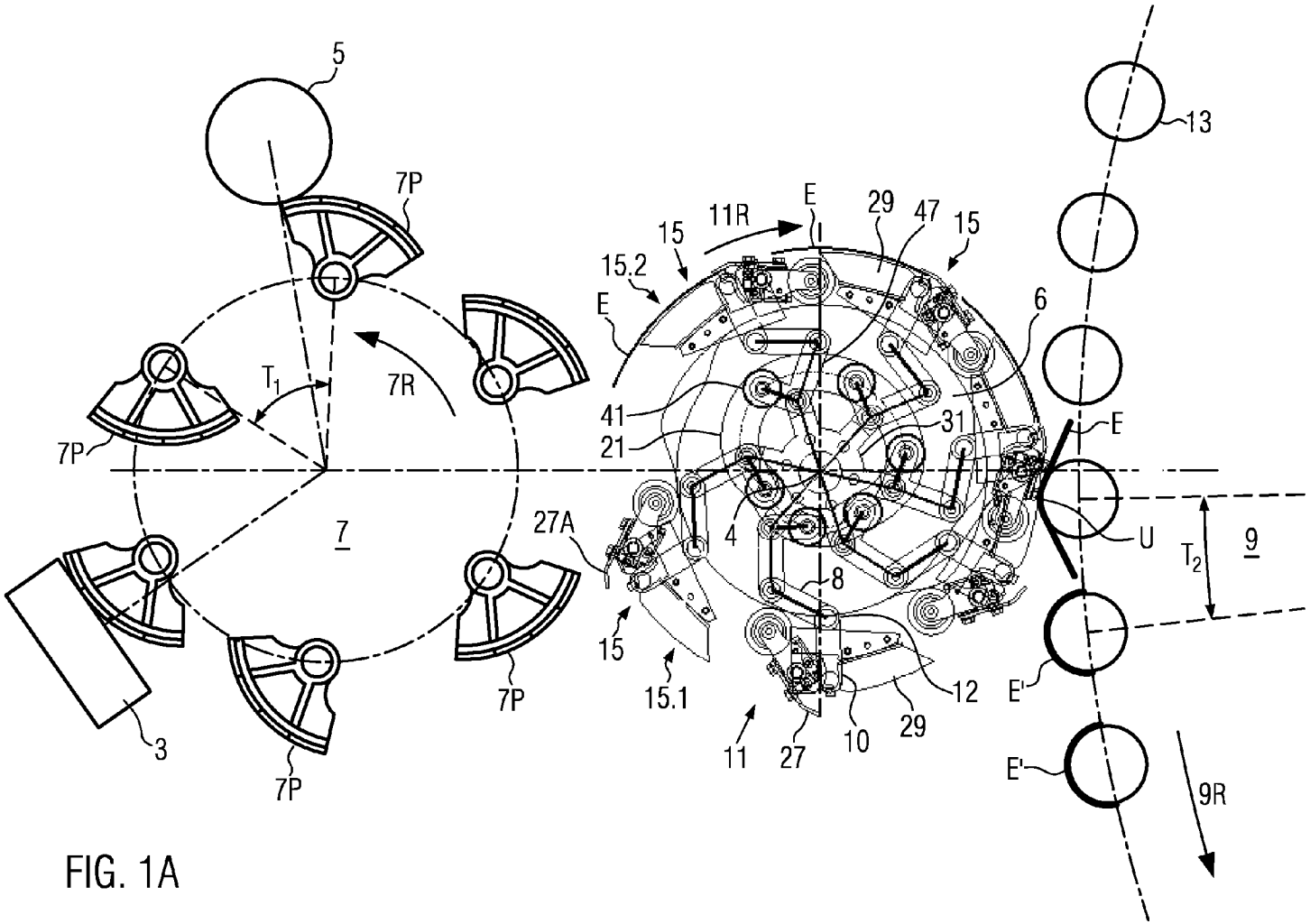
FIGS. 1A-1D show stages of a reduction within a rotation at a device for transferring labels in accordance with the disclosure.

FIGS. 1A-1D show different stages of a reduction within one rotation at a device 11 for transferring labels E, E' according to an embodiment of the present disclosure. FIGS. 1A-1D show a feeder or pallet unit with a pallet rotor 7 and pallets 7P which are mounted essentially uniformly on the periphery of the pallet rotor 7. The pallets 7P are movably suspended at axles which are essentially parallel to the axle of the pallet rotor. The distance of the central points of the axles from two adjacent pallets 7P defines a first pitch $T_1$. Furthermore, a glue station or gum roll 5 known in glue labeling, and a label reservoir 3 are shown in FIGS. 1A-1D. The pallets 7P which are essentially directed outwards and have a bent facing to the outside are guided past the gum roll 5 and there take up glue or another adhesive suited for labels. In the process, the pallet rotor 7 rotates, for example, into the direction indicated by the arrow with reference numeral 7R, that means here counter clockwise. In a roll-off movement, the pallet 7P provided with glue rolls off against a label from the label reservoir 3 and takes off this label in the process. It will be understood that the back side of the label will come into contact with the pallet 7P. The pallet provided with a label is brought, by further rotation of the pallet rotor 7, into the transfer region from the pallet rotor/feeder to the device 11, i.e. the gripper cylinder, as will be described below in further detail.

FIGS. 1A-1D furthermore show a bottle or container carousel 9 with rotary tables with containers 13 which are to be labeled. The details of the rotary tables are not shown here. The carousel 9 rotates into a sense of rotation which is indicated by the arrow with reference numeral 9R, in this case counter clockwise. The distance between the central points of two rotary tables, and thus the distance between the center of two containers, results in a pitch $T_2$, as is indicated in the figures. In the examples shown in FIGS. 1A-1D, the pitch $T_2$ differs from the pitch $T_1$ of the pallet rotor.

In FIGS. 1A-1D, rotary tables with containers 13 to which the labels are transferred by the device 11 according to the disclosure are schematically shown. A label E is merely schematically shown in a transfer point U which has just been transferred to a container 13 but not yet completely pressed against the container 13. From the transfer point U further below in the sense of rotation 9R, containers with labels E' are shown which have been pressed onto the containers, for example with the aid of pressing devices (not shown here). A possible rotary motion of the rotary tables for supporting the pressing process is also possible, but not shown here.

Between the pallet rotor 7 and the bottle carousel 9, a device 11 corresponding to the present disclosure is provided. FIGS. 1A-1D in a plan view show a six-armed support board 31 which can rotate about an axle/gripper cylinder axle 4 in the center of the device 11. Only by way of example, six retaining elements 15 are provided at the device 11 and permit to accept, at the outer periphery of the gripper cylinder 4, labels E from pallets 7P of the pallet unit 7 and to transfer them to containers 13 to be labeled on the bottle carousel 9. In the process, the device 11 in FIGS. 1A-1D rotates clockwise as is indicated by the arrow with reference numeral 11R.

Each retaining element 15 comprises an anvil element 29 which can comprise a suited anvil rail and a pressing pad with an optionally suitably worked surface, and at least one gripper finger 27. The gripper fingers 27 can grip a label E by gripping, for example, an edge of the label in a suited manner and pressing it against the anvil element 29. The anvil elements 29 with pressing pad and gripper fingers 27 are essentially located at the outer periphery of the device 11. The gripper fingers 27 show two different positions of their functions. One position with reference numeral 27*a*, see FIG. 1A, is an opened position in which the gripper finger 27 does not grip or hold a label E. A position with reference numeral 27Z, see FIG. 1C, is a position in which the gripper finger 27 grips or holds, respectively, a label E.

FIGS. 1A-1D show a sequence of subsequent positions of the gripper cylinder 11 during the transfer of labels E from the pallet unit/feeder unit 7 to the container carousel 9. This sequence takes place, by way of example, within one rotation of the gripper cylinder 11. Here, FIGS. 1A-1D do not refer to uniform time intervals during one rotation but only serve illustration purposes. Here, two of the retaining elements 15 are designated, by way of example, with reference numerals 15.1 and 15.2. These two retaining elements 15.1 and 15.2 are, by way of example, directly adjacent. The following considerations, however, can also be made for not directly adjacent retaining elements.

FIG. 1A shows a position of the device 11 in which at present none of the retaining elements 15 is in direct contact with a pallet 7P. Corresponding to the sense of rotation 7R of the pallet rotor and the sense of rotation 11R of the gripper cylinder, the retaining element 15.1 will be the next one of the six retaining elements 15 to come into contact with a pallet 7P. In FIG. 1A, the corresponding gripper finger 27 is shown in an opened basic position at the retaining element 15.1. The retaining element 15.2 is shown in a closed position and holds a label E that has already been gripped previously. The gripping process with respect to the retaining element 15.2 is not shown.

Figure 1B:
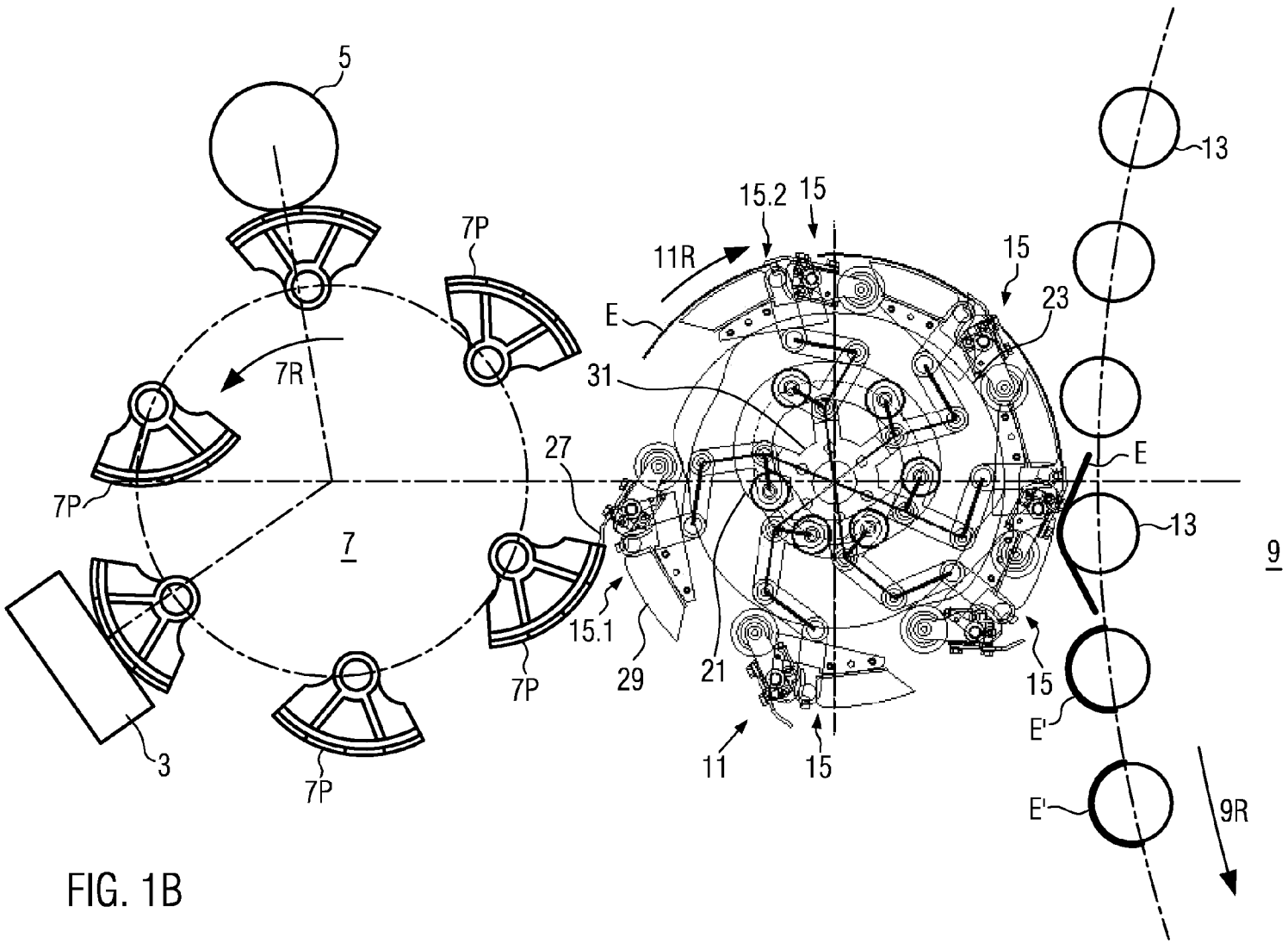
Figure 1C:
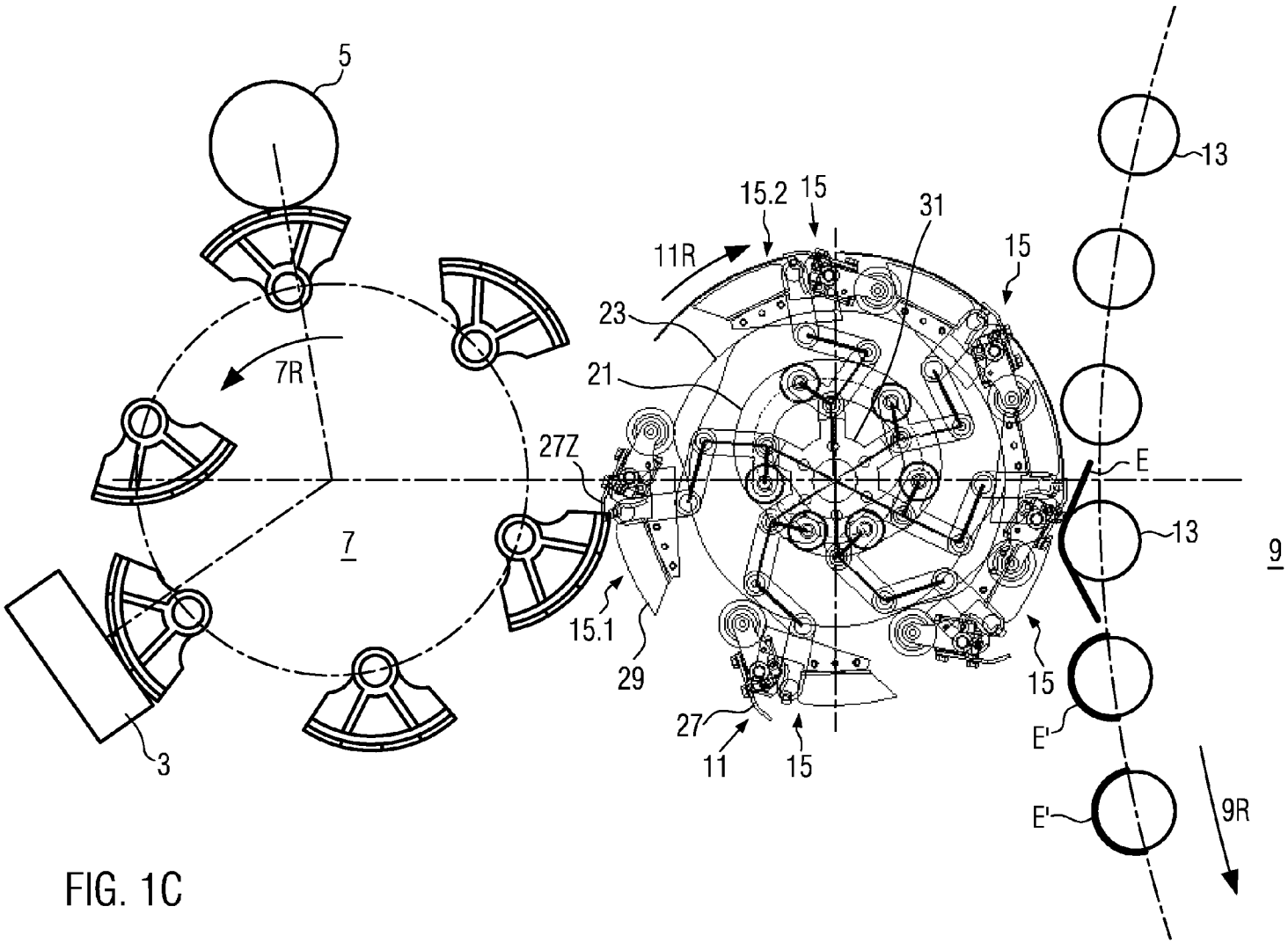
Figure 1D:
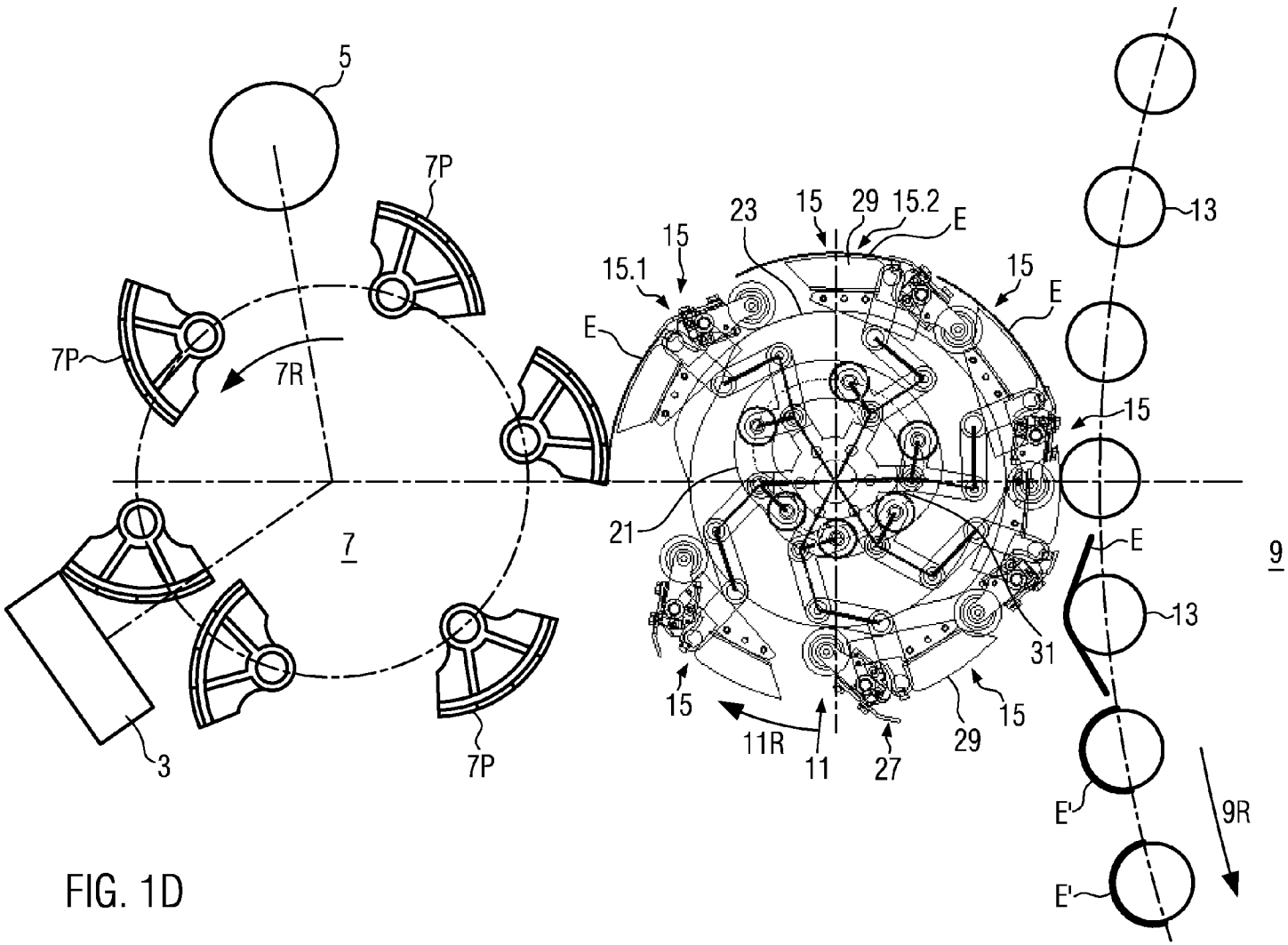

In FIG. 1B, the gripper finger 27 is shown directly before or during the contact with a pallet 7P of the pallet rotor. While in FIG. 1B, the gripper finger 27 is shown still in an opened position, it is shown in FIG. 1C in a closed position. So, in FIG. 1C, the gripper finger 27 of the retaining element 15.1 has gripped the edge of a label E at the pallet 7P and will take off or pull off the label E from the pallet 7P. In FIG. 1D, the label E has already been nearly completely taken or drawn off from the pallet 7P by means of the retaining element 15.1. Simultaneously, the movement of the retaining element 15.2 on the periphery of the gripper cylinder 11 has been delayed to prepare the label transfer to the containers 13 of the bottle carousel. By the delay, the distance between the retaining elements 15.1 and 15.2 on the periphery of the gripper cylinder has become smaller. In other words, the retaining elements 15.1 and 15.2 have been shifted closer to each other on the periphery in this example. It will be understood that the radial distance from the central axle 4 of the gripper cylinder 11 remains unchanged for each of the retaining elements 15, that means in particular for the retaining elements 15.1 and 15.2. Vice-versa, with reference to the further retaining elements 15, one can see that the distance between the retaining elements on the periphery increases again after the transfer of the labels, that means the relative speed between two retaining elements changes again to be adapted to the pitch of the pallet rotor.

The changes of speed on the periphery of the gripper cylinder 11 in FIGS. 1A-1D are accomplished, for example, with the aid of a control cam 21 in which one partial element of the retaining elements 15 each is guided by means of guide rollers 41, see FIGS. 2-5. Here, as is shown in FIGS. 1A-1D, the control cam 21 might not be circular but have a certain shape which forces a movement of a guide roller 41 on different radii, so that a non-uniform movement of the guide roller 41 can result. By means of an angular element 47, which can be angled by about 90°, this partial element is connected with the six-armed support board 31. It will be understood at this point again that the number of six arms has been selected here merely by way of example, and that a different number of retaining elements can be selected. The first partial element is connected to a further partial element via an axle 6, which is practically parallel to the axle 4 of the gripper cylinder, the further partial element in this example comprising the partial lever arms 8 and 10 which are connected with an axle 12 which is in turn essentially parallel to the axle 4 of the gripper cylinder 11. By the lever elements 8 and 10, radial changes which are induced by the control cam 21 can be compensated, so that the anvil elements 29 and the gripper fingers 27 are not affected by this. These outer parts of the retaining element 15 are movable to and fro in the circumferential direction on a circular path 34, see FIGS. 2-5. Here, the radius of these partial elements, that means in particular of the anvil elements 29 and gripper fingers 27 that hold and guide the labels, remains essentially constant. For this, these outer parts can be guided on circular paths or circular path sections by suited guiding elements, see FIGS. 2-5.

Figure 2:
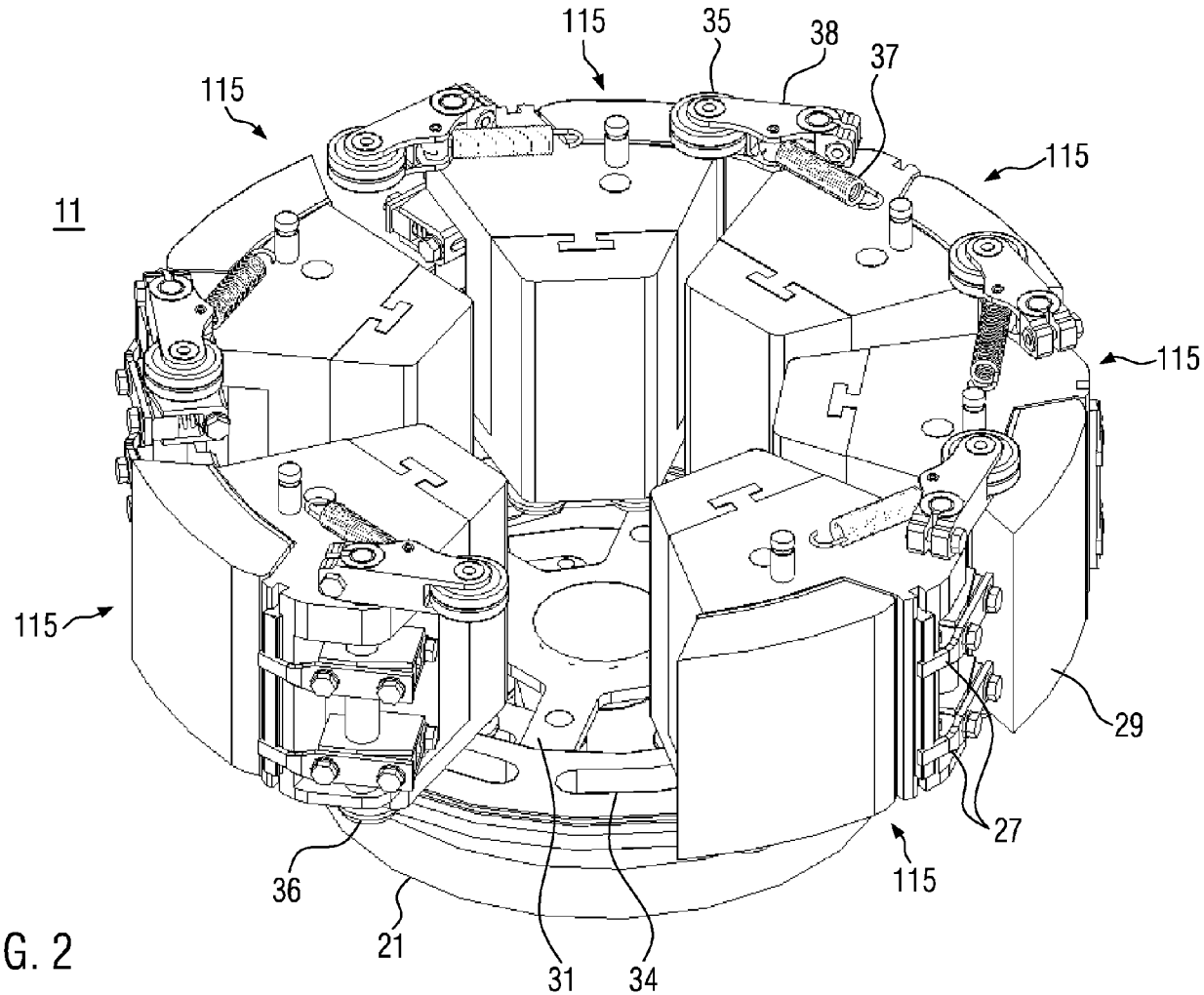
FIG. 2 shows a schematic view of a transferring device in accordance with the disclosure.

FIG. 2 shows an embodiment of a device 11 in accordance with the disclosure. Similar as in FIGS. 1A-1D, in FIG. 2, a gripper cylinder 11 with six retaining elements which is capable of reduction is shown. The retaining elements can essentially correspond to the retaining elements 15 of FIGS. 1A-1D. In FIG. 2, the upper partial elements 115 of the retaining elements are shown. A control lever for gripper fingers is designated with reference numeral 38. A corresponding spring is designated with reference numeral 37. Here, the movement of the gripper fingers can be controlled from their opened position to a closed position via the gripper finger cam roller 35 by means of a further control cam which is not shown here, as discussed with reference to FIGS. 1A-1D. Furthermore, anvil elements with anvil pads 29 are shown. FIG. 2 also shows gripper fingers 27 in a closed position. The upper elements/partial elements 115 of the retaining elements are shown above a support board 31 which can correspond to the support board 31 of FIGS. 1A-1D. Underneath the support board 31, a control cam 21 is indicated which can generate a non-uniform movement at least of the lower part of the retaining elements, see FIGS. 3-5. Above the support board 31, a circular path 34 is indicated which here comprises slots, for example, where the upper elements 115 can move to and fro to thus be able to perform the reduction motion. Equally, guide rollers 36 are indicated in FIG. 2 which ensure a guidance of the upper elements 115 with respect to the circular path 34.

Figure 3:
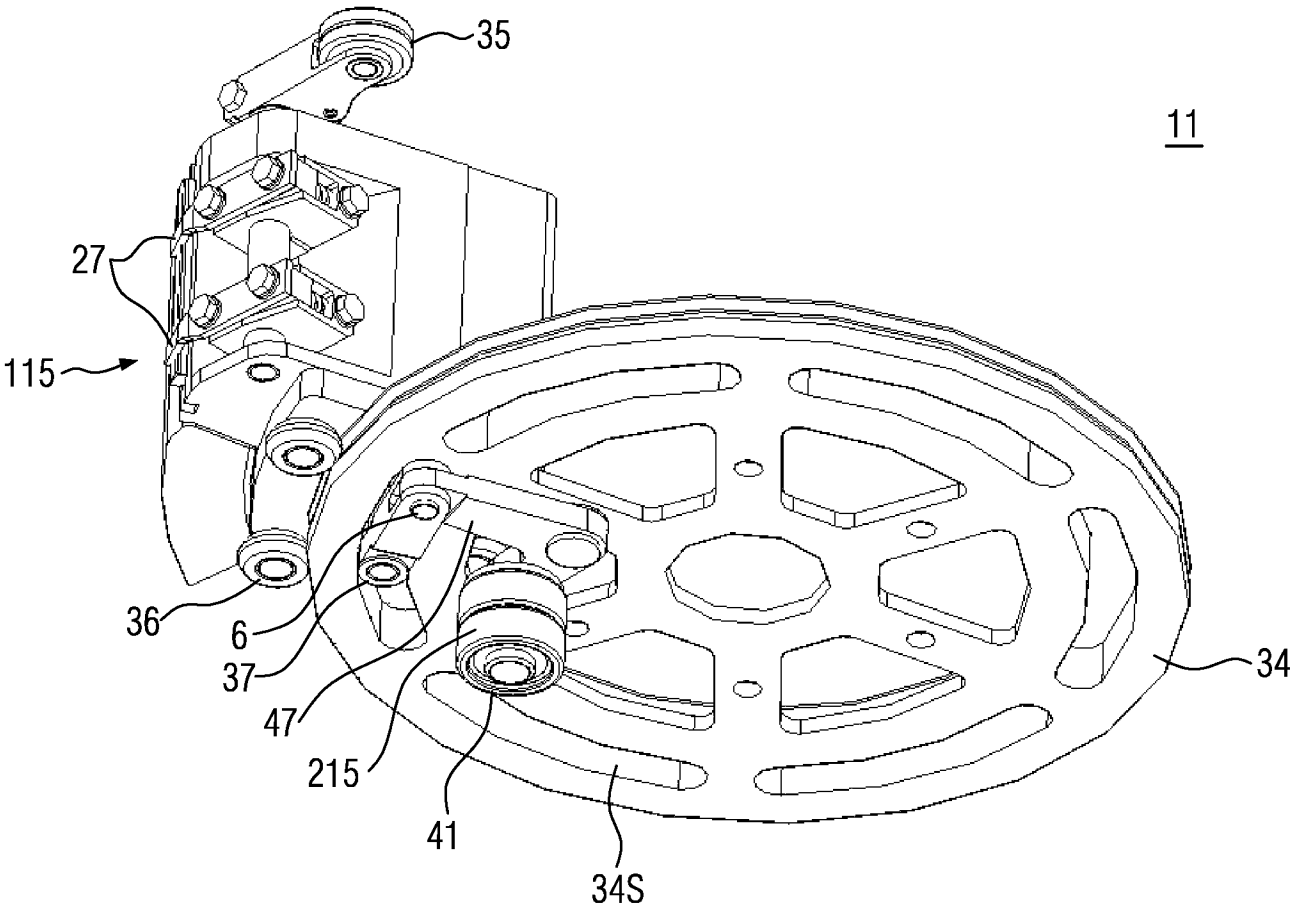
FIG. 3 shows a bottom view of a device with a retaining element in accordance with FIG. 2.

FIG. 3 shows a bottom view of the embodiment as already described with reference to FIG. 2. Parts of the device 11 according to the disclosure, which are represented in FIG. 3, comprise the circular path 34 with slots 34S. A lower element/partial element 215 of the retaining elements 15, as shown in FIGS. 1A-1D, comprises in FIG. 3 at least one cam roller 41 which is suited to roll or be guided in the control cam 21. The control cam 21 is shown, for example, in FIG. 2. The lower element is connected with parts of the upper element 115 via a tilt angle 47 and an axle 6. Here, a guide roller 37 is indicated with which the upper element 115 is guided in a slot 34S of the circular path 34. Furthermore, guide rollers 36 are indicated by which the upper element can roll or be guided on the outer edge of the circular path 34. The upper element 115 was already described with reference to FIG. 2.

Figure 4:
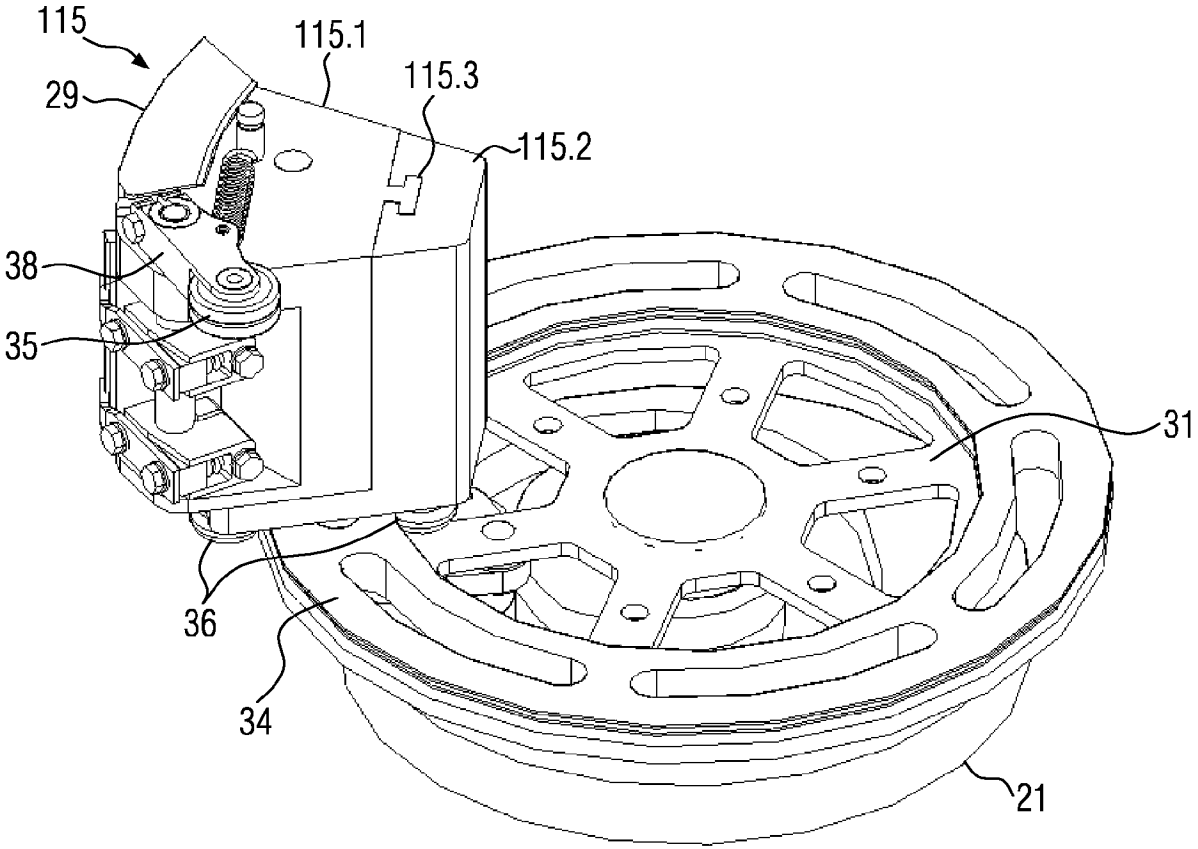
FIG. 4 shows a schematic view of a retaining element of a device in accordance with FIGS. 2 and 3.
Figure 5:
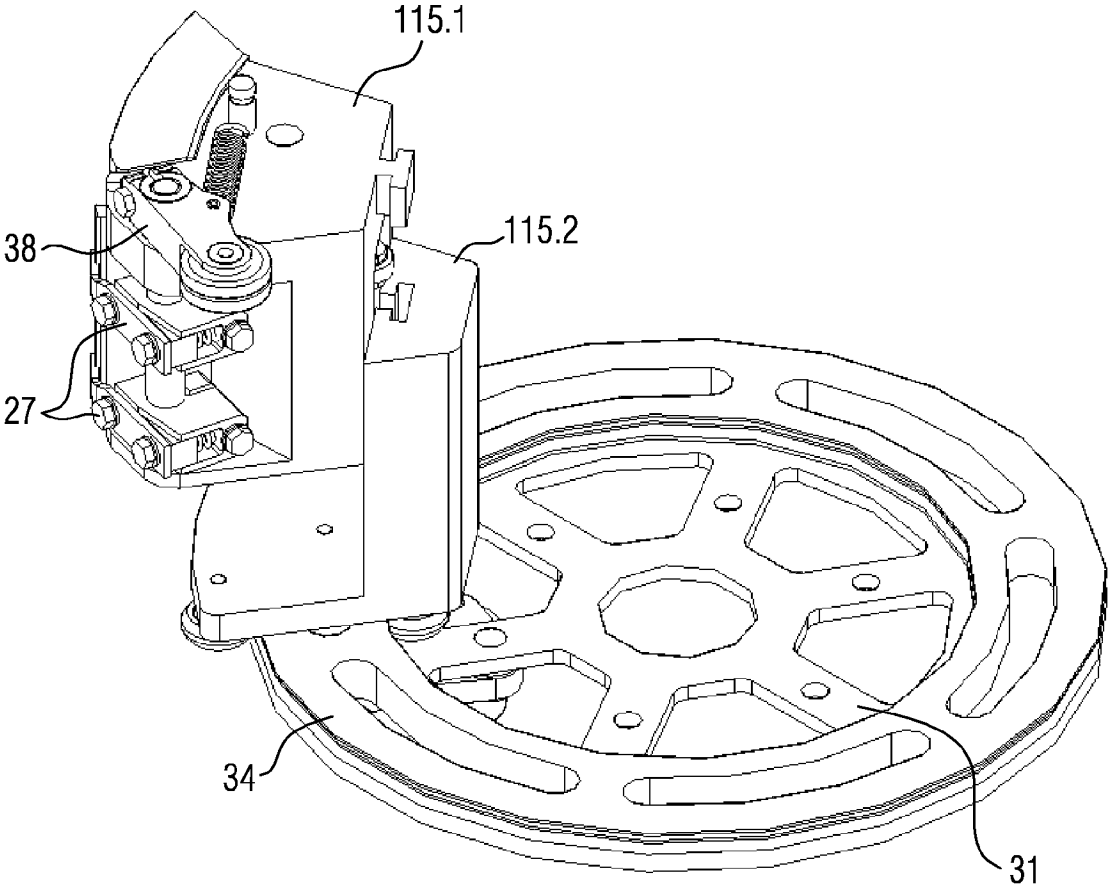
FIG. 5 shows a schematic view of a retaining element with quick-lock element in accordance with FIG. 4.

FIGS. 4 and 5 show a further aspect with respect to the upper element 115. In this embodiment, the upper element 115 can comprise at least two parts which are designated with reference numerals 115.1 and 115.2. With respect to the radial direction, the element 115.2 is located further to the inside than the element 115.1. Furthermore, guide rollers 36 are mounted, for example, at the element 115.2, so that aspects of the reduction motion in the circumferential direction are accomplished by the partial element 115.2. The partial element 115.1 is connected to the partial element 115.2 via a quick-lock or quick-couple element 115.3. The partial element 115.1 thus accomplishes the aspects of gripping, retaining, transferring and releasing labels. Mechanical control cams for the control, in particular the opening and closing of the gripper fingers, can thereby be restricted to this partial element 115.1. Furthermore, an arbitrary one of the six partial elements 115.1 shown in FIG. 2 can be quickly exchanged.

It will be understood that, while in FIGS. 1A-1D and 2 and 5, only the transfer of a label to a container was discussed, the concepts according to the disclosure can also be applied to the transfer of several labels at different levels, for example body/shoulder and neck labels.

It will be understood that the features mentioned in the above described embodiments are not restricted to special combinations but can also be possible in any other combinations.

What is claimed is:

1. A device for transferring labels in a labeling machine, comprising at least two retaining elements for holding labels, the retaining elements being mounted offset in the circumferential direction around a gripper cylinder axle of a gripper cylinder, and mechanical control means which are configured to change the relative speed between the retaining elements in the circumferential direction of the gripper cylinder;

the retaining elements comprising at least two elements which are connected in a lever type fashion around an axle which is essentially parallel to the gripper cylinder axle, wherein an upper element is configured to grip labels and is guided on a circular path, and wherein a lower element is guided on a control cam; and the upper element comprising a slide with at least one guide roller, such that the upper element is guided on the circular path.

2. The device according to claim 1, wherein the mechanical means comprise a control cam and a circular path.

3. The device according to claim 1, wherein the lower element comprises a toggle lever, and a cam roller support with at least one cam roller, which is configured to roll along the control cam.

4. The device according to claim 1, wherein the upper element comprises at least two parts which are connected with a quick-lock element, so that a front part of the slide is exchangeable and the rear part of the slide remains at the retaining element.

5. The device according to claim 1, wherein each retaining element has a separate drive so that the position of the retaining element can be adjusted by means of the separate drive.

6. The device according to claim 1, wherein the upper element of the retaining elements comprises at least one anvil element with a pressing pad and, along the anvil element, at least one gripper finger which can be adjusted with respect to the anvil element between a grip and a release position.

7. The device according to claim 1, wherein the circular path guidance of the upper element comprises a support board which is configured to rotate with a constant rotation.

8. The device according to claim 1, wherein the retaining elements are interconnected such that they can be exchanged coherently.

9. The device according to claim 1, wherein the retaining elements can be changed individually.

10. A method of transferring labels in a labeling machine with a device comprising at least two retaining elements for holding labels, the retaining elements being mounted offset in the circumferential direction around a gripper cylinder axle of a gripper cylinder, and mechanical control means which are configured to change the relative speed between the retaining elements in the circumferential direction of the gripper cylinder; and including a pallet rotor with several pallets which are provided in a first pitch at the pallet rotor, with the pallet rotor being rotatable about an axle which is essentially parallel to the gripper cylinder axle, with a container carrousel with several rotary tables with containers which are provided in a second pitch, comprising, after the acceptance of a label from the pallet by the retaining elements, adjusting the retaining elements to the second pitch of the container carrousel by changing the relative speed between the retaining elements in the circumferential direction of the gripper cylinder.

11. The method according to claim 10, wherein the basic position of the retaining element is adjustable relative to a pallet, so that labels with different lengths are gripped essentially at the same point.

12. The device according to claim 3, wherein the toggle lever is angled.

13. The device according to claim 5, wherein the separate drive is a servomotor.

* * * * *